US008610342B2

(12) United States Patent
Kohl

(10) Patent No.: US 8,610,342 B2
(45) Date of Patent: Dec. 17, 2013

(54) SPARK PLUG AND ITS METHOD OF PRODUCTION

(75) Inventor: Wolfgang Kohl, Aachen (DE)

(73) Assignee: Federal-Mogul Ignition GmbH, Wiesbaden (DE)

( * ) Notice: Subject to any disclaimer, the term of this patent is extended or adjusted under 35 U.S.C. 154(b) by 0 days.

(21) Appl. No.: 13/135,819

(22) Filed: Jul. 15, 2011

(65) Prior Publication Data

US 2012/0025690 A1 Feb. 2, 2012

(30) Foreign Application Priority Data

Jul. 17, 2010 (DE) ..... 10 2010 027 463

(51) Int. Cl.
*H01T 13/20* (2006.01)

(52) U.S. Cl.
USPC ..... 313/141; 123/169 R

(58) Field of Classification Search
USPC ..... 313/118–145; 123/169 R, 169 EL, 32, 123/41, 310
See application file for complete search history.

(56) References Cited

U.S. PATENT DOCUMENTS 4,122,366 A * 10/1978 von Stutterheim et al. ... 313/141
4,540,910 A * 9/1985 Kondo et al. ..... 313/11.5
6,304,022 B1 * 10/2001 Matsutani ..... 313/141
2002/0171346 A1 * 11/2002 Ulm et al. ..... 313/141

FOREIGN PATENT DOCUMENTS

JP 2002359053 A * 12/2002
JP 2004031300 A * 1/2004

* cited by examiner

*Primary Examiner* — Nimeshikumar Patel
*Assistant Examiner* — Jacob R Stern
(74) *Attorney, Agent, or Firm* — Reising Ethington P.C.

(57) ABSTRACT

The invention describes a spark plug, which comprises an inner conductor, an insulator enclosing the inner conductor, a spark plug body enclosing the insulator and two electrodes forming a spark gap. The first electrode is a center electrode connected to the inner conductor in an electrically conductive manner and the second electrode is a ground electrode connected to the spark plug body in an electrically conductive manner. At least one of the electrodes has a precious metal region, adjoining the spark gap and consisting predominantly of platinum, iridium or an alloy of both and containing additionally at least one brittle metal. The precious metal region consists of a base material predominantly containing platinum and/or iridium, which comprises a coating with a brittle metal, which is more brittle than the base material.

5 Claims, 1 Drawing Sheet

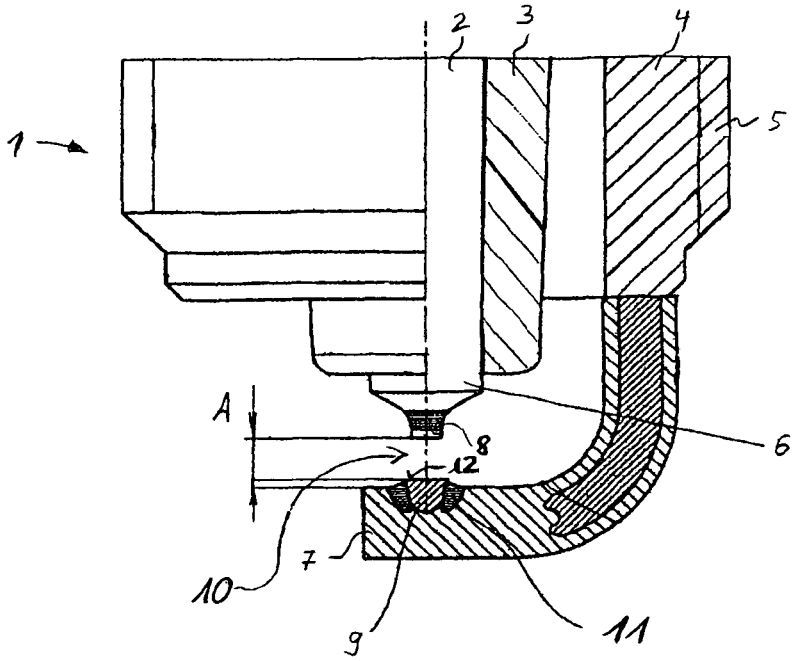
1
2
3
4
5
6
7
8
9
10
11
12
A

SPARK PLUG AND ITS METHOD OF PRODUCTION

The invention concerns a spark plug, which comprises an inner conductor, an insulator enclosing the inner conductor, a spark plug body enclosing the insulator and two electrodes forming a spark gap, wherein the first electrode is a center electrode connected to the inner conductor in an electrically conductive manner and the second electrode is a ground electrode connected to the spark plug body in an electrically conductive manner, and whereas at least one of the electrodes has a precious metal region, adjoining the spark gap and consisting predominantly of platinum, iridium or an alloy of both and containing additionally at least one brittle metal.

A spark plug of this type is disclosed in document EP 2 012 397 A2. With the known spark plug, the precious metal region is formed by a molded part. The molded part is welded on a ignoble ground electrode. As precious metal materials for the molded part, platinum, iridium and the base alloys thereof have been suggested. A large number of advantageous alloy components has been mentioned, wherein the predominant portion of said alloy components consists of brittle metals, in particular rhodium, iridium, osmium, ruthenium and tungsten.

Spark plug electrodes, which are armored with such precious metal regions, exhibit a good burn-off resistance. Long service lives of the spark plugs can thus be obtained.

The application of brittle metals as alloy components makes the material of the precious metal region also brittle and its processing even more difficult. Forming processes in particular during the production of molded parts are quite difficult.

The object of the invention is then to provide a spark plug which is easier to produce.

The object is satisfied in that the precious metal region consists of a base material predominantly containing platinum and/or iridium, which comprises a coating with a brittle metal, which is more brittle than the base material.

The spark plug according to the invention can be produced more easily. A relatively ductile material can be used for the base material of the precious metal region, which material can be formed and processed still relatively well during production. Once the precious metal region has been brought to its final form, it is provided with a brittle coating. The coating consists predominantly of a brittle metal, preferably predominantly of rhodium, iridium, osmium, ruthenium or tungsten or of a combination thereof. These metals are quite brittle and can hardly be processed by means of metal forming. The processing is easier with an application as a coating. The brittleness does not compromise the coating method.

It is particularly advantageously when the base material of the precious metal region predominantly consists of platinum and the coating predominantly of rhodium. It is quite suitable when a layer containing a portion of rhodium above 20% is present on the surface of the precious metal region.

Surprisingly, it has appeared that higher service lives can be achieved in operation with spark plugs according to the invention. A spark plug according to the invention exhibits unexpectedly a very good burn-off resistance. The service lives are increased, in particular with respect to well-known spark plugs which were armored with precious metal regions produced by melting metallurgy. This is a significant advantage in addition to easier production.

In an embodiment of the invention, the coating should advantageously contain a rare earth metal, in particular yttrium, lanthanum and/or cerium. The burn-off resistance may can be further improved by rare earth metals.

It is advantageous when the coating is a galvanized coating. The brittle metals, in particular the rhodium, can be deposited easily by galvanization. In particular, the known "pad-plating process" is used wherein the coating is applied by means of a punch, which exhibits a spongy material at one end, containing an electrolytic solution, from which the coating is deposited on the surface of the precious metal region. The galvanized coating can be thus automated easily and implemented in mass production cost efficiently. The film thickness of the coating ranges more advantageously from 0.1 μm to 1 μm, in particular between 0.1 μm and 0.5 μm.

The invention concerns moreover a method for manufacturing a spark plug of the type mentioned at the beginning. To do so, a precious metal region is formed of a base material consisting predominantly of platinum, iridium or an alloy of both. The precious metal region is brought to its final form. The precious metal region is subsequently coated with a brittle metal.

This method has the advantage that the base material of the precious metal region is still relatively ductile during production, i.e. during processing and forming and can then be processed easily. The brittle metal still need not be contained in the base material. Only once the precious metal region has been brought to its final form, the brittle metal in the form of a coating is applied on the surface of the base material. The brittle coating is hence only applied when no further forming of the precious metal region is necessary any longer.

In one embodiment, it may prove advantageous that the precious metal region, once brought to its final form, is coated and subsequently set up on the electrode and connected therewith. This embodiment has the advantage that the precious metal region is completely finished prior to connection with the electrode.

In a further embodiment, it is advantageous when the precious metal region is set up on the electrode and connected therewith prior to coating. The electrode with said precious metal region attached thereto is coated subsequently. To do so, at least the precious metal region is coated with a brittle metal. It can be provided that areas around the precious metal region may also exhibit a coating. This guarantees that also the connection region, in particular the alloy zone, between electrode and precious metal region is provided with a coating. It may prove advantageous moreover when the precious metal region formed of the base material is set up on the electrode and connected therewith, then at least the precious metal region is brought to its final form, and subsequently at least the precious metal region is coated. This procedure is especially advantageous when the precious metal region should be formed after attachment to the electrode.

A laser or electron beam welding process is particular well suitable for connecting the precious metal region to the electrode. A resistance welding process may prove advantageous when setting up the precious metal region on the electrode, in order to fix the precious metal region in view of the subsequent laser or electron beam welding process on the electrode.

A coated precious metal region can be used for fitting a ground electrode as well as for fitting a center electrode. It goes without saying that the spark plug can also include a precious metal region designed accordingly on both electrodes.

Further advantages and features of the invention can be seen in the following description of an exemplary embodiment.

Wherein

FIG. 1 shows a partially illustrated spark plug according to the invention, in enlarged and partial sectional representation.

The spark plug 1 illustrated on FIG. 1 contains an inner conductor 2, which is surrounded by an insulator 3. A spark plug body 4 is provided, which surrounds the insulator 3 and receives it. The spark plug body 4 is fitted with a thread 5 on its external surface. The spark plug contains two electrodes 6 and 7. The first electrode 6 is a center electrode, which is connected to the inner conductor 2 in an electrically conductive manner. The second electrode 7 is a ground electrode, which is connected to the spark plug body 4 in an electrically conductive manner. A precious metal region 8 is attached on the center electrode 6 and a precious metal region 9 on the ground electrode 7. The ground electrode 7 is arranged above the center electrode 6 in the form of a front electrode, so that the precious metal regions 8 and 9 face one another with a distance A and form a spark gap 10.

The spark plug 1 can be used in a well-known fashion with its thread 5 in a combustion engine. The region of the spark plug 1 with the electrodes 6 and 7 hence reaches into a combustion chamber of the combustion engine and can there ignite a fuel-air mixture.

The invention is described below using the example of the ground electrode 7 and of the precious metal region 9. The embodiments are valid similarly for the center electrode 6 and the precious metal region 8. There is no separate description so as to prevent any repetitions.

A heat resistant nickel-base alloy is particularly suitable for the ground electrode 7, for example inconel materials, in particular inconel 600. Other quite suitable alloys are nickel-base alloys, with 1.5 to 2.5% in weight silicon, 5 to 3% in weight aluminum, up to 0.5% in weight manganese and 0.05 to 0.2% in weight titanium in combination with 0.1 to 0.3% in weight zirconium and the rest consisting of nickel, wherein zirconium can be replaced in whole or in part with the double mass of hafnium. Another quite suitable nickel-base alloy comprises 1.5 to 2.5% in weight silicon, 1.5 to 3% in weight aluminum, up to 0.5% in weight manganese and 0.005 to 0.2% in weight yttrium in combination with 0.05 to 0.3% in weight lanthanum and the rest nickel.

The precious metal region 9 is formed of a base material which may consist preferably predominantly of platinum or of a platinum-base alloy. Platinum is quite ductile and can be processed and formed easily. Predominantly, ductile metals such as for instance palladium and/or rhenium are applied as alloy components. Additionally, brittle metals can also be used as alloy components, in particular iridium, in such amounts so that good processability is not compromised unacceptably.

The ground electrode 7 is provided with the precious metal region 9 during production of the spark plug 1. A component separately prefabricated of the base material is used for the precious metal region 9. The separately prefabricated component of the precious metal region 9 is set up on the ground electrode 7 and connected therewith. After setting up, the precious metal region 9 is fixed on the ground electrode 7 by resistance welding. Subsequently, the precious metal region 9 is welded to the ground electrode 7 using a laser or electron beam. An alloy zone 11 is generated consequently between the precious metal region 9 and the ground electrode 7.

Subsequently, a coating made of a brittle metal is applied to the surface 12 of the precious metal region 9. The coating preferably consists predominantly of rhodium. It is advantageous when the coating contains further components which exhibit a very high melting point, for instance rare earth metals. The coating is applied by means of a non-illustrated punch. The punch exhibits an end on which a spongy material is provided. An electrolytic solution is contained in the spongy material, which includes the metal to be applied as a coating. The punch is positioned with the spongy material on the surface 12, and the coating is deposited on the surface 12 by applying a voltage to the punch and to the ground electrode 7. It can thus be provided that the alloy zone 11 is also coated. The film thickness of the coating ranges from 0.1 to 0.5 μm.

According to the original configuration of the component used for the precious metal region 9 it may prove advantageous to bring the surface 12 of the precious metal region 9, protruding over the ground electrode 7, to its final form prior to coating, in particular after resistance welding and prior to laser welding. The precious metal region can be brought to its final form for instance using a form embossing process.

REFERENCE SIGNS

1 Spark plug
2 Inner conductor
3 Insulator
4 Spark plug body
5 Thread
6 Center electrode
7 Ground electrode
8 Precious metal region of the center electrode
9 Precious metal region of the ground electrode
10 Spark gap
11 Alloy zone
12 Surface
A Distance

The invention claimed is:

1. A spark plug, which comprises an inner conductor, an insulator enclosing the inner conductor, a spark plug body enclosing the insulator and two electrodes forming a spark gap, wherein the first electrode is a center electrode connected to the inner conductor in an electrically conductive manner and the second electrode is a ground electrode connected to the spark plug body in an electrically conductive manner, and whereas at least one of the electrodes has a precious metal region adjoining the spark gap and being predominantly comprised of platinum, iridium or an alloy of both and further comprising at least one brittle metal, wherein the precious metal region includes a base material being predominantly comprised of platinum and/or iridium and a galvanically deposited thin film coating layer covering at least a portion of the base material and being predominantly comprised of a brittle metal which is more brittle than the base material.

2. A spark plug according to claim 1 wherein the thin coating layer predominantly comprises rhodium, iridium, osmium, ruthenium or tungsten or of a combination thereof.

3. A spark plug according to claim 1 wherein the coating contains at least one rare earth metal selected from the group of yttrium, lanthanum and/or cerium.

4. A spark plug according to claim 1 wherein a film thickness of the thin coating layer ranges from 0.1 μm to 1 μm.

5. A spark plug, comprising:
an inner conductor;
an insulator enclosing the inner conductor;
a spark plug body enclosing the insulator;
a center electrode connected to the inner conductor in an electrically conductive manner;
a ground electrode connected to the spark plug body in an electrically conductive manner; and
a precious metal region attached to the center electrode, to the ground electrode or to both, wherein the precious metal region includes a base material that is predominantly comprised of platinum and is at least partially covered with a thin coating layer that is predominantly comprised of a metal more brittle than platinum and has a thin film thickness from 0.1 μm to 1 μm.

* * * * *